US009211723B2

(12) United States Patent
Kamimura

(10) Patent No.: US 9,211,723 B2
(45) Date of Patent: Dec. 15, 2015

(54) IMAGE PROCESSING APPARATUS AND METHOD FOR PROCESSING IMAGE

(71) Applicants: KABUSHIKI KAISHA TOSHIBA, Tokyo (JP); TOSHIBA TEC KABUSHIKI KAISHA, Tokyo (JP)

(72) Inventor: Akira Kamimura, Tokyo (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 123 days.

(21) Appl. No.: 14/063,386

(22) Filed: Oct. 25, 2013

(65) Prior Publication Data

US 2015/0116439 A1 Apr. 30, 2015

(51) Int. Cl.
*B41J 2/325* (2006.01)
*B41J 2/355* (2006.01)

(52) U.S. Cl.
CPC ..... *B41J 2/355* (2013.01); *B41J 2202/37* (2013.01)

(58) Field of Classification Search
USPC ..... 347/179, 171; 399/167, 399
See application file for complete search history.

(56) References Cited

U.S. PATENT DOCUMENTS

| | | | | |
|---|---|---|---|---|
| 8,760,480 | B1 * | 6/2014 | Kubo | 347/179 |
| 2011/0222951 | A1 | 9/2011 | Yahata et al. | |
| 2012/0306983 | A1 * | 12/2012 | Mizutani et al. | 347/179 |
| 2013/0258027 | A1 * | 10/2013 | Yahata et al. | 347/179 |

* cited by examiner

*Primary Examiner* — Kristal Feggins
(74) *Attorney, Agent, or Firm* — Patterson & Sheridan, LLP

(57) ABSTRACT

An image processing apparatus includes a reading unit configured to read a mark formed on a sheet an erasing unit configured to erase an image formed on the sheet, and a control unit configured to determine the number of times an image on the sheet have been erased based on the mark, and cause a first sheet to be separated from a second sheet if an image on the first sheet has been erased a predetermined number of times and an image on the second sheet has been erased less than the predetermined number of times.

15 Claims, 5 Drawing Sheets

IMAGE PROCESSING APPARATUS AND METHOD FOR PROCESSING IMAGE

FIELD

Embodiments described herein relate to an image processing apparatus.

BACKGROUND

Conventionally, an image forming apparatus such as an MFP (Multi Function Peripheral) has been used to form an image on a sheet. In addition, an image erasing apparatus has been used to erase an image formed on the sheet with an erasable coloring agent such as a toner containing leuco dye when the image is not necessary anymore, so that the sheet can be reused.

Because such an erasable coloring agent is decolorized when heated to a high temperature, the sheet can be reused after an image on a sheet is heated and erased by the image erasing apparatus. In such an image erasing apparatus, a press roller and a heat source are oppositely arranged with each other across a sheet conveyance path, and a sheet is conveyed between the press roller and the heat source such that an erasable coloring agent on the sheet is decolorized by the heating. The aforementioned erasing of the image formed on a sheet is hereinafter referred to as 'color erasing.' The reuse of sheets saves sheets and is beneficial to the environment.

Further, the conventional image erasing apparatus determines whether or not each of the sheets is reusable after the image printed on the sheet with an erasable coloring agent is processed by an erasing section, and sorts out the sheets by conveying reusable sheets to a reuse cassette and non-reusable sheets to a reject cassette according to the result of the determination. The reusability is determined according to whether or not there is a residual image and the state (deformed, damaged, stained, and the like) of the sheet.

In addition, as there is a practical limit on the number of times sheet can be reused, a sheet is conveyed to the reject cassette as a non-reusable sheet if it has been reused for N times.

However, the erasable toner is not necessary to print an image on the sheet that will not be reused any more as the erasing will not be carried out. The use of the erasable toner in such a printing leads to an unnecessary increase in cost as the erasable toner is generally more expensive than ordinary toners.

DETAILED DESCRIPTION

Figure 1:
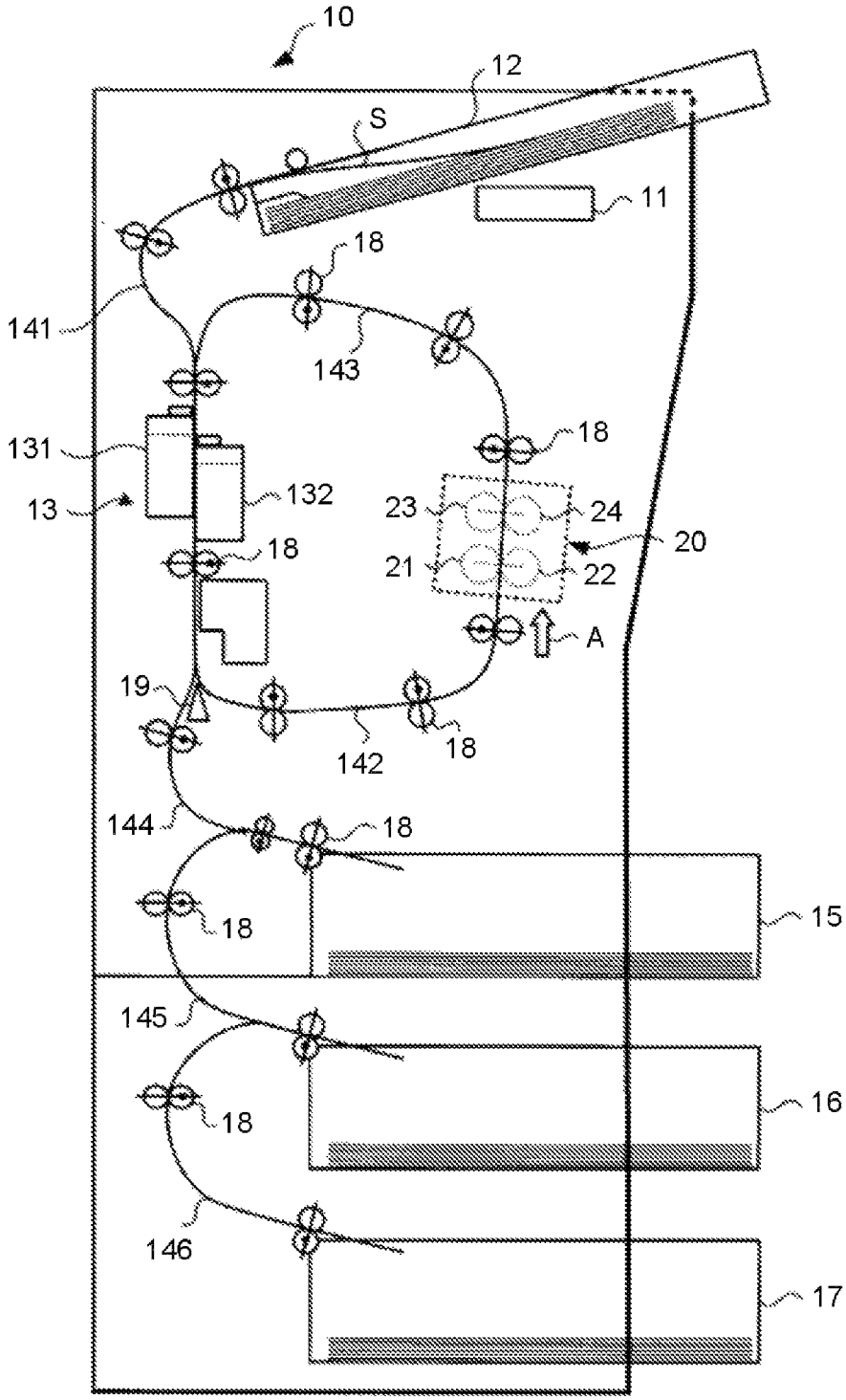
FIG. 1 is a diagram illustrating a specific configuration of an erasing apparatus according to a first embodiment.

According to embodiments, an image processing apparatus includes, a reading unit configured to read a mark formed on a sheet an erasing unit configured to erase an image formed on the sheet, and a control unit configured to determine the number of times an image on the sheet have been erased based on the mark, and cause a first sheet to be separated from a second sheet if an image on the first sheet has been erased a predetermined number of times and an image on the second sheet has been erased less than the predetermined number of times. Embodiments of the present invention are described in detail below with reference to accompanying drawings. In addition, in each of the accompanying drawings, the same reference numeral denotes the same section.

(First Embodiment)

FIG. 1 is a diagram illustrating the image erasing apparatus (hereinafter referred to as an erasing apparatus) according to a first embodiment. An erasing apparatus 10 comprises an operation section 11 having an operation panel and a display, a sheet feeding section 12, and a scanner 13 serving as a reading section. The erasing apparatus 10 further comprises a first to a sixth conveyance paths 141-146, a first sheet discharging cassette 15, a second sheet discharging cassette 16, and a third sheet discharging cassette 17.

To convey a sheet, a plurality of motor-driven conveyance rollers 18 are arranged along each of the conveyance paths 141-146. Further, agate 19 is arranged to guide sheets towards the conveyance path 142 or the conveyance path 144. Further, an erasing section 20 is arranged along the conveyance path 142.

Along the first conveyance path 141 a sheet S is conveyed from the sheet feeding section 12 to the scanner 13. Along the second conveyance path 142 the sheet S is conveyed from the scanner 13 to the erasing section 20 in a direction shown by an arrow A. Along the third conveyance path 143 the sheet S is conveyed from the erasing section 20 to the scanner 13. Along the fourth conveyance path 144 the sheet S is conveyed from the scanner 13 to the first sheet discharging cassette 15. Along the fifth conveyance path 145 the sheet S is conveyed from the scanner 13 to the second sheet discharging cassette 16. Along the sixth conveyance path 146 the sheet S is conveyed from the scanner 13 to the third sheet discharging cassette 17.

The fourth to sixth conveyance paths 144-146 may be arranged in such a manner that the conveyance paths 144-146 all start from the position of the gate 19 and bifurcate towards the first-third sheet discharging cassettes 15-17 en route.

The first sheet discharging cassette 15 is, for example, a reuse cassette for storing a reusable sheet on which an image erasing processing is carried out. The second sheet discharging cassette 16 is a reject cassette for storing sheets (non-reusable sheets) which is hardly reusable and recycle of which is rejected. The third sheet discharging cassette 17 is a last reuse cassette for storing a sheet number of reuse times of which is about to reach an allowable number of times (N times).

Herein, if the allowable number of reuse times is N, then the third sheet discharging cassette 17 stores a sheet which has been reused for (N−1) times, that is, a sheet on which characters are printed (an image is formed) for the last time. The third sheet discharging cassette 17 is a cassette to store the sheet which has been reused for (N−1) times.

In the following description, the first sheet discharging cassette 15 is referred to as a reuse cassette 15, the second sheet discharging cassette 16 is referred to as a reject cassette 16, and the third sheet discharging cassette 17 is referred to as a last reuse cassette 17.

The erasing apparatus 10 shown in FIG. 1 substantially carries out the following erasing processing. First, a user selects a color erasing mode and a reading mode for a sheet S using the operation section 11. Then, the sheet S is conveyed from the sheet feeding section 12 to the scanner 13 serving as a reading section through the first conveyance path 141. The scanner 13 includes a first scanner 131 and a second scanner 132 for reading two sides of the sheet S. The scanner 13 scans an image to read out image data before the image on the sheet S is erased and the mark (will be described later) is printed on the sheet S. In addition, according to the image read by the scanner 13, a controller 101 (described later) determines the toner coverage rate and the printing condition of the sheet S.

The state of the sheet S is checked according to the printing condition determined according to the image read by the scanner 13, and the sheet S is determined to be non-reusable if there is a deformation or damage, such as a rip or a crumple, on the sheet S. The sheet S which is determined to be not-reusable is conveyed to the reject cassette 16 via the fifth conveyance path 145. Further, a sheet with a high toner coverage rate, which is likely to curl in erasing processing, is determined to be non-reusable and conveyed to the reject cassette 16. A sheet S without any rip or crumple is conveyed to the erasing section 20 through the second conveyance path 142.

The erasing section 20 comprises a first erasing section including a heat roller 21 and a press roller 22 and a second erasing section including a press roller 23 and a heat roller 24, and the sheet S is conveyed and heated between the heat roller 21 and the press roller 22 and between the press roller 23 and the heat roller 24. Heat sources are arranged inside the heat rollers 21 and 24, respectively. Temperature detecting sections are arranged on the outside periphery of the heat rollers 21 and 24, respectively. A lamp can be used as the heat source.

The sheet S conveyed to the erasing section 20 is heated when passing through the erasing section 20 to erase the image formed on the sheet S by the heating. The erasing section 20 erases the image on the sheet S by heating and pressurizing the sheet S at a relatively high temperature, for example 180-200 degrees centigrade. That is, an erasable coloring agent, which will be erased at a given temperature, is used in the formation of an image on the sheet S. Thus, the color of the sheet S can be decolorized by conveying the sheet S at a preset conveyance speed to the erasing section 20 which heats the sheet at a given temperature.

The sheet S passing through the erasing section 20 is conveyed to the scanner 13 again via the third conveyance path 143. The scanner 13 reads the image on the sheets to obtain the printing condition to determine whether or not the image formed with an erasable coloring agent is actually erased and distinguishes sheets S.

The sheet S, which is determined to be reusable since the image formed on the sheet is determined to be erased according to the reading result of the scanner 13, is conveyed to the reuse cassette 15 via the fourth conveyance path 144. Further, the sheet S, which is determined to be non-reusable since the sheet is ripped or crumpled in addition to having a residual image formed with an non-erasable coloring agent or a hand-drawn image left in the image area of the sheet according to the printing condition determined according the image read by the scanner 13, is conveyed to the reject cassette 16 via the fifth conveyance path 145. Furthermore, the scanner 13 reads the mark printed on the sheet S to determine the number of reuse times. Afterwards, the sheet which has been reused for (N−1) times is stored in the last reuse cassette 17 as a specific sheet which can be reused for the last time.

Figure 2:
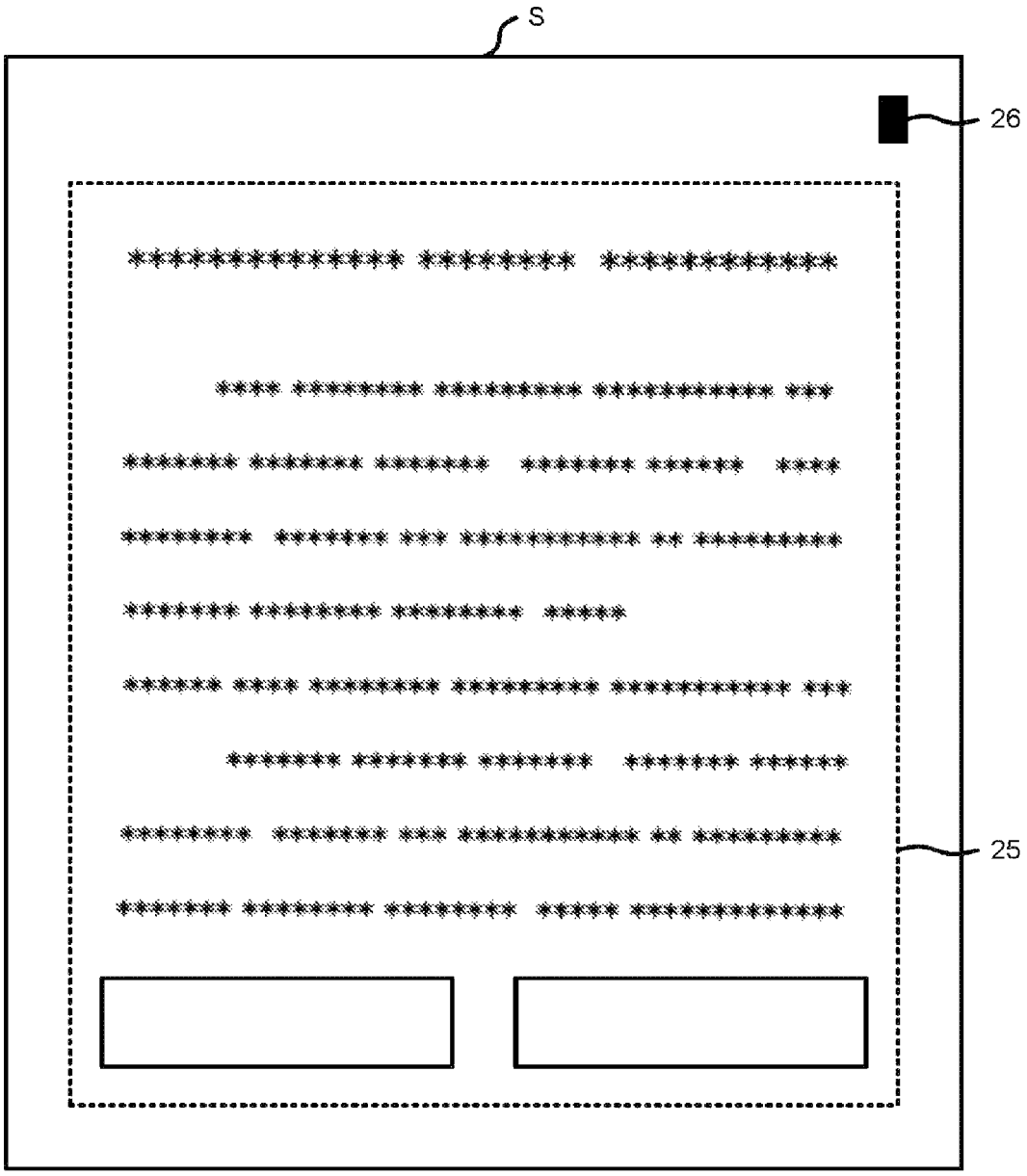
FIG. 2 is a diagram illustrating an example of an image and a mark formed on a sheet according to the embodiment.

FIG. 2 shows an example of an image 25 and a mark 26 formed on a sheet S. The image 25 is printed with an erasable coloring agent (erasable toner or ink), and the mark 26 is printed with a non-erasable coloring agent, which will not be erased even if being heated. The mark 26 is identification information for identifying the sheet S and is printed on both sides of the sheet. The scanner 13 determines the number of reuse times of the sheet S by reading the mark 26.

For example, in a storage section of the erasing apparatus 10, the information (the image 25 and the mark 26) on two sides of the sheet S read by the scanner 13 is stored at a unit of sheet, and the number of reuse times of the sheet appended with the same mark (identification information) is counted. Moreover, in the case where the allowable number of reuse times is set to be N, the sheet S which has been reused for (N−1) times is conveyed to the last reuse cassette 17 via the six conveyance path 146. It is desired to print the mark 26 on a corner of the sheet S in an inconspicuous size.

Further, an IC chip may be attached instead of printing the mark 26 on a sheet S. In this case, the identification information stored in the IC chip on the sheet S is read, and when the identification information of the same IC chip is read for (N−1) times, the sheet S is conveyed to the last reuse cassette 17.

Further, two sides of a sheet may be reused for different times. In this case, the sheet is conveyed to the last reuse cassette 17 when either side thereof is reused for (N−1) times.

Figure 3:
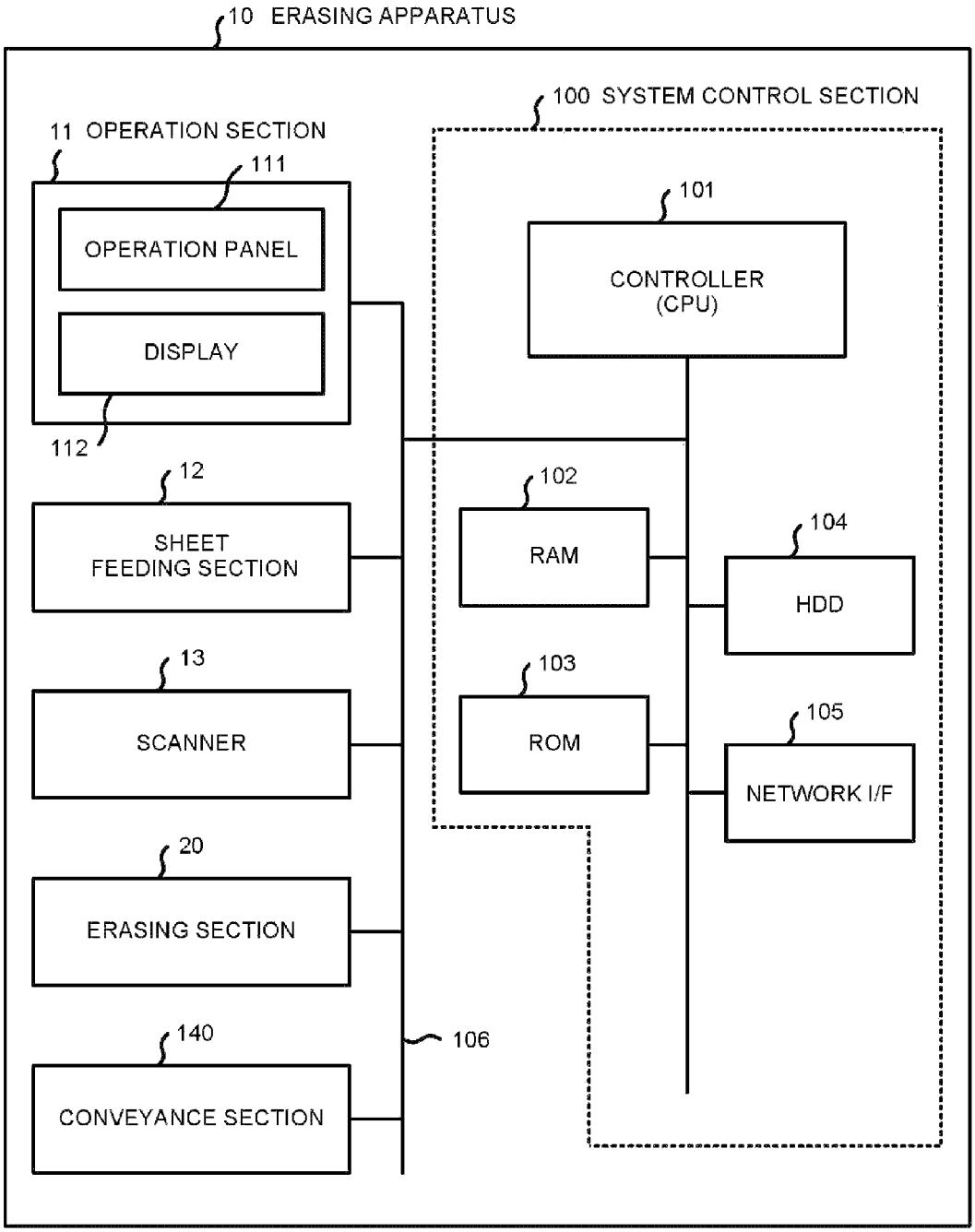
FIG. 3 is a block diagram illustrating a control system of the erasing apparatus according to the embodiment.

FIG. 3 is a block diagram illustrating the control system of the erasing apparatus 10. The erasing apparatus 10 comprises a system control section 100 for uniformly controlling each section of the erasing apparatus 10. The system control section 100 comprises a CPU 101 serving as a controller, a RAM (random access memory) 102, a ROM (read only memory) 103, an HDD (hard disk drive) 104, and a network interface (I/F) 105, and the like.

Further, the operation section 11, the sheet feeding section 12, the scanner 13, the erasing section 20, and a conveyance section 140 are connected with the system control section 100 via a bus line 106. The operation section 11 comprises an operation panel 111 and a display 112, and the conveyance section 140 comprises a motor (not shown) for driving the plurality of conveyance rollers 18 arranged along each of the conveyance paths 141-146.

The CPU 101 performs various processing functions by executing a control program stored in the ROM 103. The RAM 102 is a main memory functioning as a working memory. The ROM 103 stores the control program and control data for controlling the operations of the erasing apparatus 10 and performs various processing functions.

The HDD 104 is a high-capacity data storage memory capable of storing various kinds of information, for example, the image data and the reading data of the mark 26 read by the scanner 13. The network interface (I/F) 105 is an interface for communicating with an image forming apparatus and another external apparatus (e.g. PC) via a local area network.

Next, the operation of erasing the image on a sheet S and the operation of conveying the sheet S carried out in the erasing apparatus 10 according to an embodiment are described.

In the erasing apparatus 10 described herein, the number of reuse times of a sheet can be obtained by reading the mark 26. Thus, when the number of allowable number of reuse times is set to be N, the sheet which has been reused for (N−1) times is recognized and conveyed to the last reuse cassette 17 to be distinguished.

An erasable toner is usually more expensive than an ordinary toner. In addition to that a deformed, damaged, or stained sheet or a sheet having a residual image left thereon is determined to be a non-reusable sheet, the number of reuse times is also checked in the process of determining whether or not the sheet is reusable. The sheet which has been reused for (N−1) times is conveyed to and stored in the last reuse cassette 17 although the sheet is reusable. Then, the sheet stored in the last reuse cassette 17 is printed with an ordinary color inerasable toner. The use of the ordinary toner, which is cheaper than the erasable toner, can reduce printing cost.

Even if the sheet reused for (N−1) times is used to print an image with the erasable toner, the sheet is still determined to be non-reusable after being used for the last time and conveyed to the reject cassette 16 to be rejected. Further, if the sheet reused for (N−1) times is used to print an image with an ordinary toner, the sheet is determined to be non-reusable after being used for the last time and conveyed to the reject cassette 16 to be rejected. Since the sheet reused for (N−1) times is rejected anyway, the use of an ordinary toner in the final printing can reduce the cost.

Figure 4:
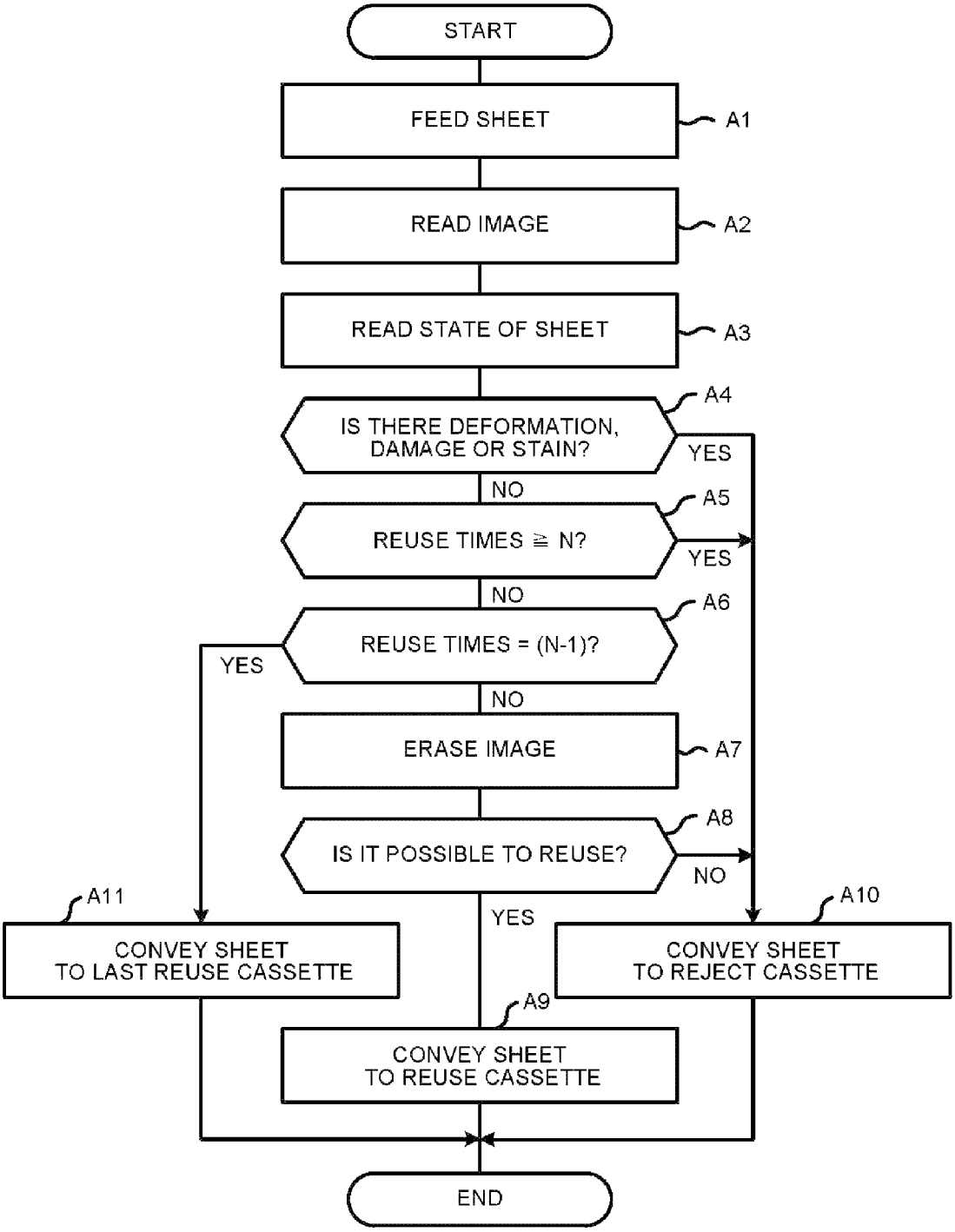
FIG. 4 is a flowchart illustrating a sheet conveyance operation according to the embodiment.

FIG. 4 is a flowchart illustrating an operation of conveying a sheet S carried out under the control of the CPU 101.

In ACT A1 shown in FIG. 4, the CPU 101 instructs the sheet feeding section 12 to feed a sheet S. The CPU 101 instructs the scanner 13 to read the image (including a mark 26) printed on the sheet S in ACT A2. The CPU 101 controls the storage section so that the read image data is stored in the storage section such as the HDD 104. The CPU 101 reads the state of the sheet in ACT A3. That is, the CPU 101 acquires state information of the sheet.

In ACT A4, the CPU 101 determines whether or not the sheet S is deformed, damaged, or stained based on the result of the reading in ACT A3. If it is determined that the sheet S is deformed, damaged, or stained (YES in ACT A4), the CPU 101 determines the sheet to be non-reusable. In this case, the CPU 101 proceeds to ACT A10 to instruct the conveyance section 140 to convey the sheet S to the reject cassette 16.

If it is determined in ACT A4 that the sheet S is not deformed, damaged, or stained (NO in ACT A4), the CPU 101 determines whether or not the number of reuse times of the sheet S is less than an allowable number of times (N times) in ACT A5. That is, in ACT A5, the mark 26 contained in the image read in ACT A3 is determined, and if the same mark 26 is read for more than N times, then the flow proceeds to ACT A10 to convey the sheet S to the reject cassette 16.

In addition, the scanner section 13 sometimes reads the sheet S fed from the sheet feeding section 12 and the sheet S the image on which is erased by the erasing section 20. Thus, when counting the number of reuse times of the sheet S, the CPU 101 determines the number of reuse times based on the information read when the sheet S is fed from the sheet feeding section 12.

In addition, if it is determined in ACT A5 that the number of reuse times is less than N times, the CPU 101 determines whether or not the number of reuse times is (N−1) in ACT A6. If it is determined in ACT A6 that the number of reuse times is (N−1), the CPU 101 proceeds to ACT A11 to instruct the conveyance section 140 to convey the sheet S to the last reuse cassette 17.

If it is determined in ACT A6 that the number of reuse times is less than (N−1), the CPU 101 causes the sheet S to be conveyed to the erasing section 20 via the second conveyance path 142 in ACT A7 and controls the erasing section 20 to erase the image on the sheet S. Further, the CPU 101 controls the scanner 13 to read the sheet S again and determines whether or not the sheet S is reusable in the following ACT A8. If it is determined in ACT A8 that the sheet is non-reusable since an image which cannot be erased remains on the sheet or that the sheet is deformed, damaged, or stained, the flow proceeds to ACT A10 to instruct the conveyance section 140 to convey the sheet S to the reject cassette 16.

Further, if it is determined in ACT A8 that the sheet S is reusable (YES in ACT A8), the CPU 101 instructs the conveyance section 140 to convey the sheet S to the reuse cassette 15 in ACT A9 and then ends the operation. In addition, the mark 26 is not erased, but it can be ignored since it is tiny.

As stated above, a sheet which has been reused for (N−1) times is stored in the last reuse cassette 17. Since the sheet stored in the last reuse cassette 17 is a sheet for the last reuse, the user can be prompted to print the sheet using an image forming apparatus with an ordinary toner, which reduces the cost significantly compared to a printing with the erasable toner. In addition, if there is a sheet conveyed to the last reuse cassette 17, a message such as 'please print the sheet in the last reuse cassette with an ordinary toner' is displayed on the display 112 of the operation section 11.

(Second Embodiment)

Figure 5:
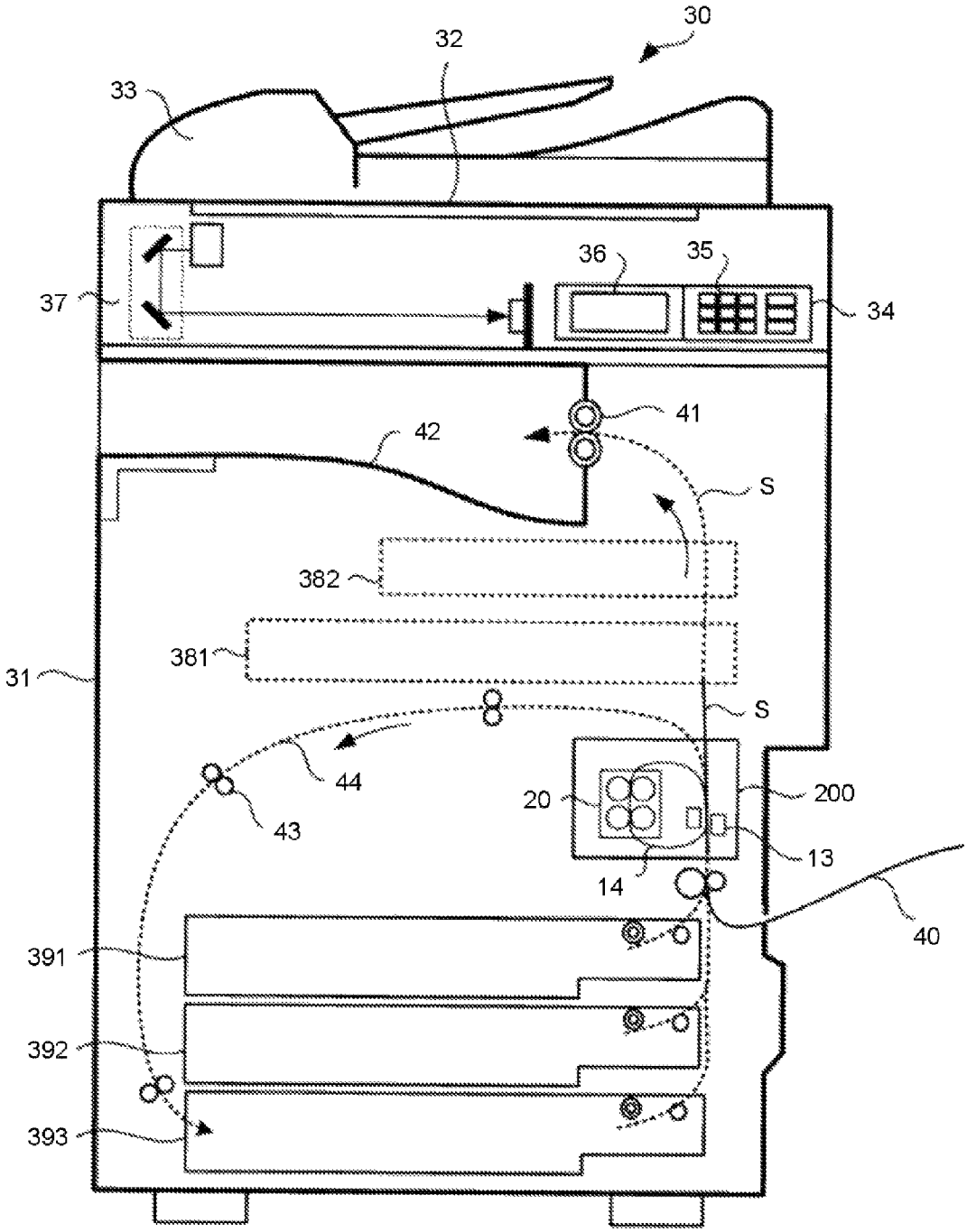
FIG. 5 is a diagram of an image forming apparatus including the image erasing apparatus according to a second embodiment.

FIG. 5 is a diagram illustrating an image forming apparatus comprising the image erasing apparatus according to a second embodiment. In FIG. 5, an image forming apparatus 30 is, for example, a MFP (Multi-Function Peripherals) serving as a compound machine, a printer, and a copier. A MFP is described as an example of the image forming apparatus 30 in the following description.

A document table 32, on which an automatic document feeder (ADF) 33 is arranged in a freely opened or closed manner, is arranged on the upper portion of a main body 31 of the MFP 30. Further, a control panel 34 is arranged on the upper portion of the main body 31. The control panel 34 includes various operation keys 35 and a touch-panel-type display section 36.

A scanner section 37, a first image forming section 381, and a second image forming section 382 are arranged inside the main body 31, and a plurality of cassettes 391, 392, and 393 for storing sheets of different sizes are arranged on a lower portion of the main body 31. For example, sheets for printing are stored in the cassettes 391 and 392. Further, a reusable sheet (a sheet which can be reused) the image on which has been erased is stored in the cassette 393. That is, the cassette 393 is a reuse cassette. Furthermore, the main body 31 comprises a manual feeding tray 40.

The scanner section 37 reads the document conveyed from the ADF 33 or the document placed on the document table 32. The first image forming section 381 comprises a photoconductive drum, a developer, a transferring device, and a fixer and processes the image data read by the scanner section 37 and the image data created by a PC (personal computer) and the like to form an image on a sheet.

The first image forming section 381 forms an image on a sheet with an ordinary color inerasable toner which will not be erased even when being heated. The second image forming section 382 forms an image on a sheet with an erasable toner or ink containing leuco dye. An exemplary use of the erasable toner as an erasable coloring agent is illustrated in the following description. A sheet S on which an image is formed by the first image forming section 381 or the second image forming section 382 is guided towards the sheet discharging roller 41 and discharged to a sheet discharging section 42 through the sheet discharging roller 41.

Further, an erasing apparatus 200 is included in the main body 31. The erasing apparatus 200 comprises a scanner 13 serving as a reading section, a conveyance path 14 for conveying a sheet, and an erasing section 20. The scanner 13 of the erasing apparatus 200 scans the image on a reusable sheet fed from the manual feeding tray 40 serving as a sheet feeding section, reads out image data before the image on the sheet S is erased, and reads the mark 26 printed on the sheet.

In addition, a controller (not shown) determines the toner coverage rate and the printing condition of the sheet S according to the image read by the scanner 13. If the result of the reading on the sheet S indicates that the sheet S has been reused for more than N times or has a deformation or damage such as a rip or a crumple thereon, then the sheet S is determined to be non-reusable and then discharged to the sheet discharging section 42. Further, a sheet of a high toner coverage rate, which is likely to curl in erasing processing, is determined to be non-reusable and discharged to the sheet discharging section 42.

A sheet without any rip or crumple is conveyed to the erasing section 20 via the conveyance path 14. The erasing section 20 conveys and heats the sheet S while the sheet is in between the press roller and the heat roller to erase the image formed on the sheet S by the heating. The sheet S passing through the erasing section 20 is conveyed to the scanner 13 again, and the scanner 13 scans the sheet S to check whether or not the image formed with an erasable coloring agent is actually erased, and the sheet which is determined to be reusable since the image formed thereon is erased is conveyed to the sheet discharging cassette (the reuse cassette) 393 as a reusable sheet. A conveyance path 44 along which a conveyance roller 43 is disposed extends from the erasing section 20 to the reuse cassette 393 to convey the reusable sheet to the reuse cassette 393 where the reusable sheet is stored.

Further, the sheet S, which is determined to be non-reusable since the sheet is ripped or crumpled in addition to having a residual image formed with a non-erasable coloring agent or a hand-drawn image left in the image area of the sheet according to the image on the sheet S read by the scanner 13, is conveyed to the sheet discharging section 42.

The image forming apparatus 30 is capable of displaying a menu on the touch panel type display section 36 for a user to select an erasing mode or a printing mode. If the user selects the erasing mode, then the image formed on a sheet S with an erasable toner is erased by the erasing apparatus 200. At this time, the image forming sections 381, 382 in a standby state execute no image forming operation. If the printing mode is selected, then the erasing apparatus 200 only enables the scanner 13 to operate and executes no erasing operation.

Further, if the printing mode is selected, the user can determine whether or not to print an image with an ordinary toner or an erasable toner. If the ordinary toner is selected, the image is formed on a sheet by the first image forming section 381. If the erasable toner is selected, the image is formed on a sheet by the second image forming section 382.

Further, the user may also select a mode to print an image on a reusable sheet with the erasable toner. In this mode, the image is formed by the image forming section 382 on the reusable sheet stored in the reuse cassette 393 or the reusable sheet which is extracted from the reuse cassette 393 and placed on the manual feeding tray 40. The scanner 13 of the erasing apparatus 200 reads the mark 26 printed on the reusable sheet S and the controller determines the number of reuse times. If the number of reuse times of the sheet is (N−1), then the image is formed by the first image forming section 381, but not by the second image forming section 382, with an ordinary toner.

The sheet, which has been reused for (N−1) times, is determined to be non-reusable after being reused for the last time since the number of reuse times reaches the allowable number of times N. Thus, printing an image on the sheet with an ordinary toner for the last reuse can reduce the cost.

As stated above, a determination of whether or not the number of reuse times reaches an upper limit (N−1) may be carried out in an image forming apparatus including an image forming section for forming an image with an ordinary toner and an image forming section for forming an image with an erasable toner, and a switching is carried out to form an image with an ordinary toner if the number of reuse times reaches the upper limit, thus reducing printing cost.

Further, in the description above, as an example, the allowable number of reuse times is set to be N and a determination of whether or not the number of reuse times is (N−1) is carried out. However, a sheet which has been reused for (N−m) times, that is, the number of reuse times of the sheet is m times less than the allowable number of times N (N>m), may be determined as a specific sheet. That is, the upper limit of the number of reuse times may also be set to be (N−2), (N−3), and the like. Further, the user can also change the upper limit (N−1, N−2, . . . ) of the number of reuse times.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image processing apparatus, comprising:

a reading unit configured to read a mark formed on a sheet;

an erasing unit configured to erase an image formed on the sheet;

a first sheet storing unit;

a second sheet storing unit; and a control unit configured to determine the number of times images on the sheet have been erased based on the mark, and cause the sheet to be stored in the first sheet storing unit when the images on the sheet are determined to have been erased a predetermined number of times and in the second sheet storing unit when the images on the sheet are determined to have been erased less than the predetermined number of times.

2. The image processing apparatus according to claim 1, wherein the sheet is stored in the first or the second sheet storing unit, after the image formed on the sheet has been erased by the erasing unit.

3. The image processing apparatus according to claim 1, wherein the image formed on the sheet is erased by the erasing unit after the mark thereon has been read by the reading unit.

4. The image processing apparatus according to claim 1, further comprising:

a third sheet storing unit, wherein the control unit is further configured to cause the sheet to be stored in the third sheet storing unit, when the images on the sheet are determined to have been erased more than the predetermined number of times.

5. The image processing apparatus according to claim 4, wherein the sheet is stored in the third sheet storing unit, without the image formed thereon being erased by the erasing unit.

6. The image processing apparatus according to claim 1, wherein the mark is formed on the sheet with a non-erasable material.

7. A method for processing a sheet having an image formed thereon, comprising:

reading a mark formed on the sheet;

determining the number of times images on the sheet have been erased based on the mark; and conveying the sheet to a first sheet storing unit, if the images are determined to have been erased a predetermined number of times and to a second sheet storing unit, if the images are determined to have been erased less than the predetermined number of times.

8. The method according to claim 7, further comprising:

erasing the image formed on the sheet, wherein the sheet is conveyed to the first or the second sheet storing unit after the image formed on the sheet has been erased.

9. The method according to claim 8, wherein the image formed on the sheet is erased after the mark thereon has been read.

10. The method according to claim 7, further comprising:

conveying the sheet to a third sheet storing unit, if the images are determined to have been erased more than the predetermined number of times.

11. The method according to claim 10, wherein the sheet is conveyed to the third sheet storing unit without erasing the image formed thereon.

12. An image processing apparatus, comprising:

a reading unit configured to read a mark formed on a sheet;

an erasing unit configured to erase an image formed on the sheet;

a printing unit configured to print a new image on the sheet the image on which has been erased by the erasing unit, with an erasable material or a non-erasable material; and a control unit configured to determine the number of times images on the sheet have been erased based on the mark, and control the printing unit to print the new image with the non-erasable material on the sheet when the images are determined to have been erased a predetermined number of times and with the erasable material on the sheet when the images are determined to have been erased less than the predetermined number of times.

13. The image processing apparatus according to claim 12, further comprising:

a first sheet storing unit; and a second sheet storing unit, wherein the control unit is configured to cause the sheet to be conveyed to the first sheet storing unit after the image thereon has been erased by the erasing unit and from the first sheet storing unit to the printing unit, when the images are determined to have been erased the predetermined number of times, and to the second sheet storing unit after the image thereon has been erased by the erasing unit and from the second sheet storing unit to the printing unit, when the images are determined to have been erased less than the predetermined number of times.

14. The image processing apparatus according to claim 12, wherein the image on the sheet is erased by the erasing unit after the mark thereon has been read by the reading unit.

15. The image processing apparatus according to claim 12, further comprising:

a sheet storing unit, wherein the control unit is configured to cause the sheet to be stored in the sheet storing unit without printing when the images are determined to have been erased more than the predetermined number of times.

* * * * *